US009808902B2

(12) United States Patent
Dovel

(10) Patent No.: US 9,808,902 B2
(45) Date of Patent: Nov. 7, 2017

(54) POWERED TOOL SHARPENER WITH MULTI-SPEED ABRASIVE

(71) Applicant: Darex, LLC, Ashland, OR (US)

(72) Inventor: Daniel T. Dovel, Shady Cove, OR (US)

(73) Assignee: Darex, LLC, Ashland, OR (US)

( * ) Notice: Subject to any disclaimer, the term of this patent is extended or adjusted under 35 U.S.C. 154(b) by 0 days.

(21) Appl. No.: 15/430,252

(22) Filed: Feb. 10, 2017

(65) Prior Publication Data

US 2017/0232569 A1 Aug. 17, 2017

Related U.S. Application Data

(60) Provisional application No. 62/294,354, filed on Feb. 12, 2016.

(51) Int. Cl.

| | |
|---|---|
| ***B24B 3/54*** | (2006.01) |
| ***B24B 49/10*** | (2006.01) |
| ***B24B 51/00*** | (2006.01) |
| ***B24B 21/00*** | (2006.01) |

(52) U.S. Cl.

CPC ..... *B24B 3/54* (2013.01); *B24B 21/002* (2013.01); *B24B 51/00* (2013.01)

(58) Field of Classification Search

CPC ..... B24B 3/54; B24B 49/10

USPC ..... 451/5, 45, 297–311, 296; 76/82, 86, 88

See application file for complete search history.

(56) References Cited

U.S. PATENT DOCUMENTS

| | | | | |
|---|---|---|---|---|
| 2,249,218 | A | 7/1941 | Meade et al. | |
| 2,566,809 | A * | 9/1951 | Risley | B24B 3/54 192/113.1 |
| 4,964,241 | A | 10/1990 | Conklin | |
| 8,585,462 | B2 * | 11/2013 | Jensen | B24B 3/54 451/349 |
| 8,696,407 | B2 * | 4/2014 | Dovel | B24B 3/52 451/296 |
| 8,784,162 | B1 | 7/2014 | Dovel | |
| 8,915,766 | B1 * | 12/2014 | Kolchin | B24B 3/54 451/45 |
| 8,944,894 | B2 | 2/2015 | Smith et al. | |
| 2004/0198198 | A1 | 10/2004 | Friel, Sr. et al. | |
| 2008/0188164 | A1 | 8/2008 | Droese | |
| 2008/0261494 | A1 | 10/2008 | Friel et al. | |
| 2011/0136412 | A1 | 6/2011 | Dovel | |
| 2011/0201257 | A1 | 8/2011 | Walker | |
| 2011/0281503 | A1 | 11/2011 | Knecht et al. | |
| 2013/0165021 | A1 * | 6/2013 | Jensen | B24B 3/54 451/41 |
| 2013/0324014 | A1 | 12/2013 | Dovel | |

* cited by examiner

*Primary Examiner* — Robert Rose

(74) *Attorney, Agent, or Firm* — Hall Estill Attorneys at Law

(57) ABSTRACT

Method and apparatus for sharpening a cutting tool. In some embodiments, a sharpener has a guide assembly adjacent a moveable abrasive medium. The medium is advanced at a first speed relative to the guide assembly during a coarse sharpening operation in which a user presents the cutting tool against the medium to shape a side of the cutting tool and generate distended material from the cutting edge (e.g., burrs). The medium is subsequently slowed to a lower, second speed for a fine sharpening operation in which the user presents the cutting tool against the medium to remove the distended material and provide a sharpened cutting edge.

29 Claims, 11 Drawing Sheets

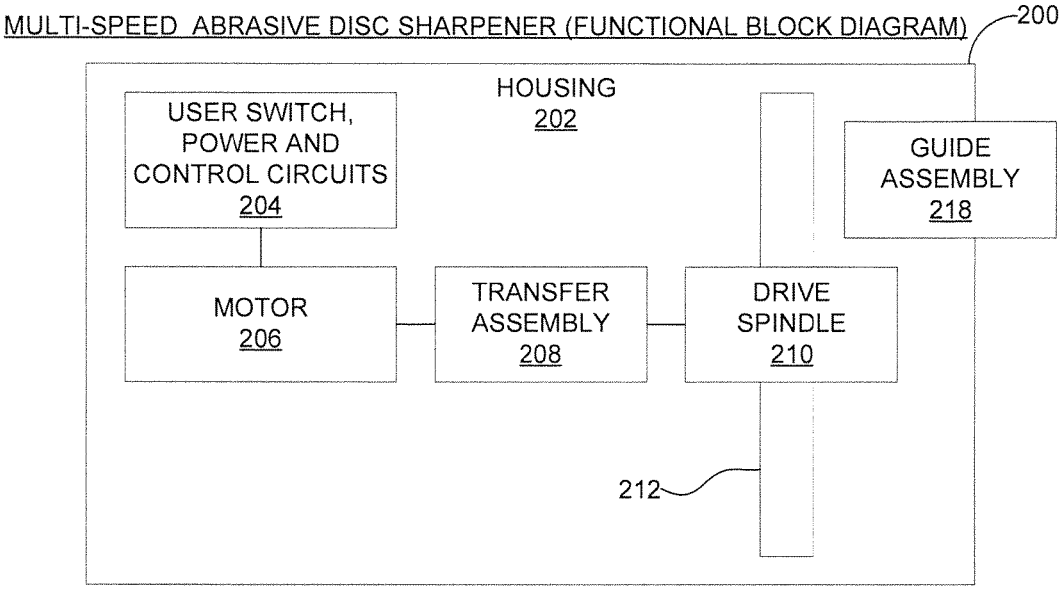
FIG. 7
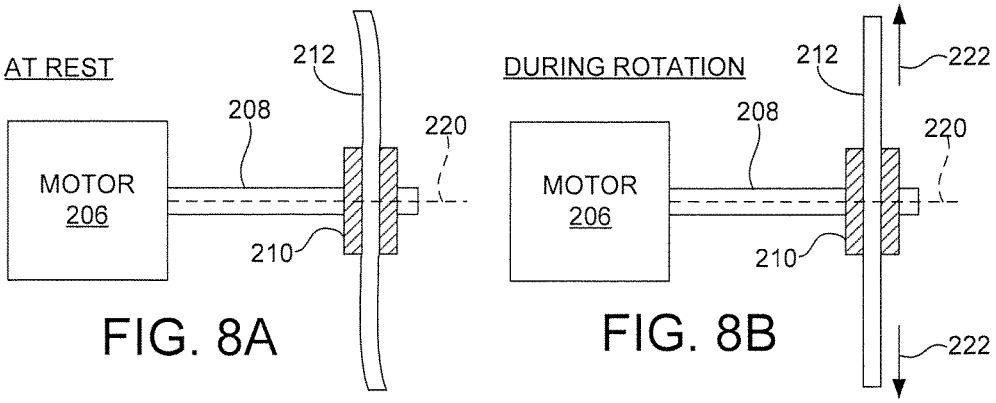
FIG. 8A
FIG. 8B
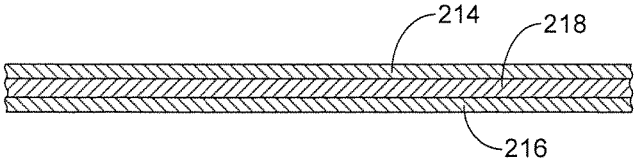
FIG. 8C

DULL

COARSE

FINE

POWERED TOOL SHARPENER WITH MULTI-SPEED ABRASIVE

RELATED APPLICATION

The present application makes a claim of domestic priority under 35 U.S.C. 119(e) to U.S. Provisional Patent Application No. 62/294,354 filed Feb. 12, 2016, the contents of which are hereby incorporated by reference.

BACKGROUND

Cutting tools are used in a variety of applications to cut or otherwise remove material from a workpiece. A variety of cutting tools are well known in the art, including but not limited to knives, scissors, shears, blades, chisels, machetes, saws, drill bits, etc.

A cutting tool often has one or more laterally extending, straight or curvilinear cutting edges along which pressure is applied to make a cut. The cutting edge is often defined along the intersection of opposing surfaces (bevels) that intersect along a line that lies along the cutting edge.

In some cutting tools, such as many types of conventional kitchen knives, the opposing surfaces are generally symmetric; other cutting tools, such as many types of scissors and chisels, have a first opposing surface that extends in a substantially normal direction, and a second opposing surface that is skewed with respect to the first surface.

Complex blade geometries can be used, such as multiple sets of bevels at different respective angles that taper to the cutting edge. Scallops or other discontinuous features can also be provided along the cutting edge, such as in the case of serrated knives.

Cutting tools can become dull over time after extended use, and thus it can be desirable to subject a dulled cutting tool to a sharpening operation to restore the cutting edge to a greater level of sharpness. A variety of sharpening techniques are known in the art, including the use of grinding wheels, whet stones, abrasive cloths, abrasive belts, etc.

SUMMARY

Various embodiments of the present disclosure are generally directed to a method and apparatus for sharpening a cutting tool, such as but not limited to a kitchen knife.

In some embodiments, a sharpener has a guide assembly adjacent a moveable abrasive medium. The medium is advanced at a first speed relative to the guide assembly during a coarse sharpening operation in which a user presents the cutting tool against the medium to shape a side of the cutting tool and generate distended material from the cutting edge (e.g., burrs). The medium is subsequently slowed to a lower, second speed for a fine sharpening operation in which the user presents the cutting tool against the medium to remove the distended material and provide a sharpened cutting edge.

These and other features and advantages of various embodiments will be understood from a review of the following detailed description in conjunction with the accompanying drawings.

BRIEF DESCRIPTION OF DRAWINGS

FIG. 7 is a functional block diagram for a multi-speed abrasive disc sharpener constructed and operated in accordance with various embodiments of the present disclosure.

FIGS. 8A and 8B show respective schematic representations of aspects of the sharpener of FIG. 7 at rest and during rotation, respectively.

FIG. 8C shows the flexible disc from FIGS. 8A and 8B in accordance with some embodiments.

DETAILED DESCRIPTION

Figure 1:
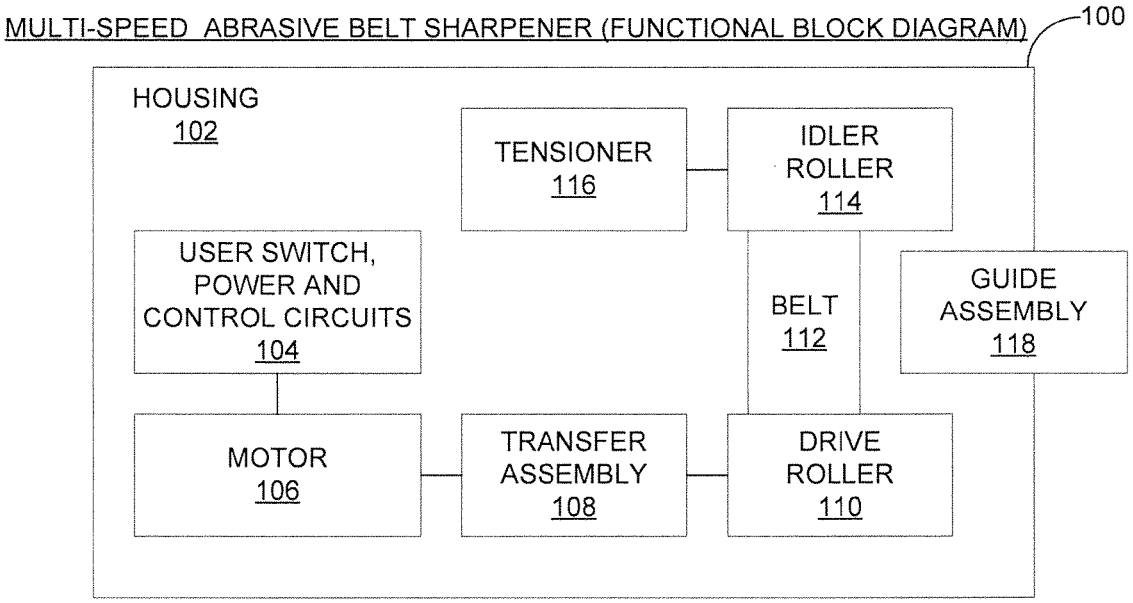
FIG. 1 provides a functional block diagram for a multi-speed abrasive belt sharpener constructed and operated in accordance with various embodiments of the present disclosure.

Multi-stage sharpeners are known in the art to provide a succession of sharpening operations to the cutting edge of a cutting tool, such as but not limited to a kitchen (chef) knife, to produce an effective cutting edge. One example of a multi-stage sharpener is provided in U.S. Pat. No. 8,696, 407, assigned to the assignee of the present application and hereby incorporated by reference, which provides a slack belt powered sharpener in which multiple abrasive belts can be successively installed in a sharpener to provide different levels and angles of shaping to obtain a final desired geometry on a cutting tool. Other multi-stage sharpeners are well known in the art that use a variety of abrasive media, including rotatable grinding wheels, carbon rippers, abrasive rods, etc.

These and other forms of multi-stage sharpeners generally enact a sharpening scheme whereby a coarse sharpening stage is initially applied to quickly remove a relatively large amount of material from the cutting tool to produce an initial blade geometry. One or more fine sharpening stages are subsequently applied to refine the geometry and "hone" the blade to a final cutting edge configuration. In some cases, relatively larger grit abrasives are used during coarse sharpening followed by the use of relatively finer grit abrasives to provide the final honed blade. The honing operation can remove striations and other marks in the blade material left by the coarser abrasive, and hone the final cutting edge to a relatively well defined line.

In some embodiments such as taught by the '407 patent, different effective sharpening angles can be applied to further enhance the multi-stage sharpening process. For example, the coarse sharpening can occur at a first bevel angle, such as about 20 degrees with respect to a longitudinal axis of the blade, and the fine sharpening can occur at a different second bevel angle, such as about 25 degrees with respect to the longitudinal axis of the blade.

While these and other forms of sharpeners have been found operable in producing sharpened tools, the use of multiple stages increases the complexity and cost of the associated sharpener. One factor that can increase such complexity and cost is the need to utilize different abrasive media to effect the various sharpening stages. For example, the '407 patent teaches to have the user remove and replace different belts with different levels of abrasiveness and different linear stiffnesses in order to carry out the different sharpening operations. Other sharpeners provide multiple sharpening stages within a common housing with different abrasive media (e.g., rotatable discs, carbon rippers, abrasive rods, etc.) so that the user successively inserts the blade into or against different guide assemblies (guide slots with associated guide surfaces) to carry out the multi-stage sharpening operation against different abrasive surfaces.

Accordingly, various embodiments of the present disclosure provide a number of different, related sharpeners that can carry out multi-stage sharpening operations using a common abrasive medium. In some embodiments, the common abrasive medium is an endless abrasive belt. In other embodiments, the common abrasive medium is a rotatable abrasive disc. Other forms of abrasive medium are envisioned, so that these examples are merely exemplary and not necessarily limiting.

As explained below, a coarse sharpening operation is generally carried out by presenting the tool to be sharpened via a guide assembly against a moveable abrasive medium. A coarse mode of operation is selected so that the medium moves at a first relative speed with respect to the tool. It is contemplated although not necessarily required that the first relative speed is a relatively high rate of speed in terms of unit of distance transversed adjacent the tool with respect to time (e.g., X feet per minute, fpm).

A fine (honing) mode of operation is subsequently selected so that the medium moves at a different, second relative speed with respect to the tool. It is contemplated that the second speed will be significantly less than the first speed (e.g., Y fpm where $Y<X$).

In some embodiments, the first rate of removal is selected to be high enough to form a burr, which as explained below is a displaced extent of material from the cutting edge. The second rate of material is selected to be high enough to remove the burr but low enough such that the lower rate of speed does not significantly alter the underlying geometry of the blade.

In some cases, both coarse and fine grinding are carried out with the medium moving in the same direction with respect to the tool. In other cases, the coarse grinding may take place with the medium moving in one direction and the fine grinding taking place with the medium moving in an opposite direction. In further cases, the final pass of the fine grinding operation is carried out with the abrasive surface of the medium moving toward the cutting edge rather than away from the edge. For example, using a substantially horizontal blade with the cutting edge along a lowest point thereof, toward the cutting edge may be a direction that is generally upwardly, while away from the cutting edge may be in a direction that is generally downwardly. These relative directions may be reversed.

These and other features, advantages and benefits of various embodiments can be understood beginning with a review of FIG. 1 which provides a functional block diagram representation of a powered multi-speed abrasive belt sharpener 100 in accordance with some embodiments. It is believed that an initial overview of various operative elements of the sharpener 100 will enhance an understanding of various sharpening geometries established by the sharpener which will be discussed below. It will be appreciated that sharpeners constructed and operated in accordance with various embodiments can take various forms so that the particular elements represented in FIG. 1 are merely for illustrative purposes and are not limiting.

The exemplary sharpener 100 is configured as a powered sharpener designed to rest on an underlying base surface, such as a table top, and to be powered by a source of electrical power such as residential or commercial alternating current (AC) voltage, a battery pack, etc. Other forms of tilted sharpeners can be implemented, including non-powered sharpeners, hand-held sharpeners, etc.

The sharpener 100 includes a rigid housing 102 that may be formed of a suitable rigid material such as but not limited to injection molded plastic. A user switch, power and control circuitry module 104 includes various elements as required including user operable switches (e.g., power, speed control, etc.), power conversion circuitry, control circuits, sensors, user indicators (e.g., LEDs, etc.).

An electrical motor 106 induces rotation of a shaft or other coupling member to a transfer assembly 108, which may include various mechanical elements such as gears, linkages, etc. to in turn impart rotation to one or more drive rollers 110. As explained below, the respective module 104, motor 106 and linkage 108 are variously configured such that, responsive to user inputs, the drive roller 110 is rotated in two separate and distinct rotational velocities. In some cases, three or more separate and distinct rotational velocities may be used. While not necessarily required, changes in rotational direction can also be imparted to the drive roller by such mechanisms.

An endless abrasive belt 112 extends about the drive roller 110 and at least one additional idler roller 114. In some cases, multiple rollers may be employed by the sharpener, such as three or more rollers to define a multi-segmented belt path. A tensioner 116 may impart a bias force to the idler roller 114 to supply a selected amount of tension to the belt. A guide assembly 118 is configured to enable a user to present a cutting tool such as a knife against a segment of the belt 112 between the respective rollers 110, 114 along a desired presentation orientation, as discussed below.

Figure 2A:
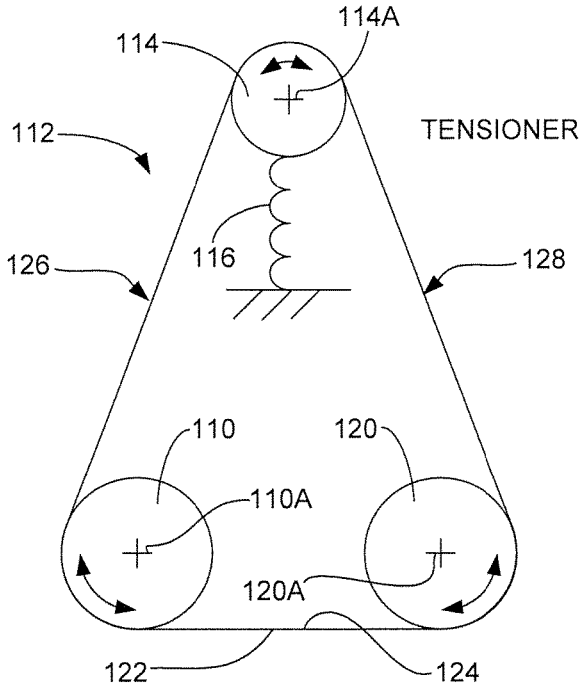
FIG. 2A is a schematic depiction of aspects of the sharpener of FIG. 1.

A schematic representation of one exemplary belt path is provided in FIG. 2A in accordance with some embodiments. A generally triangular path is established for the belt 112 through the use of three rollers: the drive roller 110 in the lower left corner, the idler roller 114 at the top of the belt path, and a third roller 120 which may also be an idler roller. It will be appreciated that any number of belt paths can be established using any suitable corresponding numbers and sizes of rollers as desired so that a triangular path is used in some embodiments, but not others. The tensioner 116 (FIG. 1) is represented as a coiled spring operable upon the idler roller 114 in a direction away from the remaining rollers 110, 120. Other tensioner arrangements can be used including, for example, a tensioner that applies the tension force to lower idler roller 120.

Figure 2B:
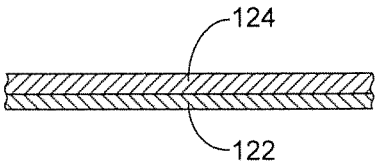
FIG. 2B shows the belt from 2A in greater detail.

The belt 112 has an outer abrasive surface denoted generally at 122 and an inner backing layer denoted generally at 124 that supports the abrasive surface. These respective layers are generally represented in FIG. 2B. The abrasive surface 122 includes a suitable abrasive material operative to remove material from the knife during a sharpening operation, while the backing layer 124 provides mechanical support and other characteristic features for the belt such as belt stiffness, overall thickness, belt width, etc. The backing layer 124 is configured to contactingly engage the respective rollers during powered rotation of the belt along the belt path.

The exemplary arrangement of FIG. 2A establishes two respective, elongated planar segments 126, 128 of the belt 112 against which the knife or other cutting tool can be presented for sharpening operations on alternate sides thereof. Segment 126 substantially extends from roller 114 to roller 110, and segment 128 substantially extends from roller 120 to roller 114. Each of the segments 126, 128 normally lies along a neutral plane that is parallel to respective rotational axes 110A, 114A and 120A of the rollers 110, 114 and 120.

Each segment 126, 128 is further shown to be unsupported by a corresponding restrictive backing support member against the backing layer 124. This allows the respective segments to remain aligned along the respective neutral planes in an unloaded state and to be rotationally deflected ("twisted") out of the neutral plane during a sharpening operation through contact with the knife. It is contemplated that one or more support members can be applied to the backing layer 128 in the vicinity of the segments 126, 128, such as in the form of a leaf spring, etc., so long as the support member(s) still enable the respective segments to be rotationally deflected away from the neutral plane during a sharpening operation.

Figure 3:
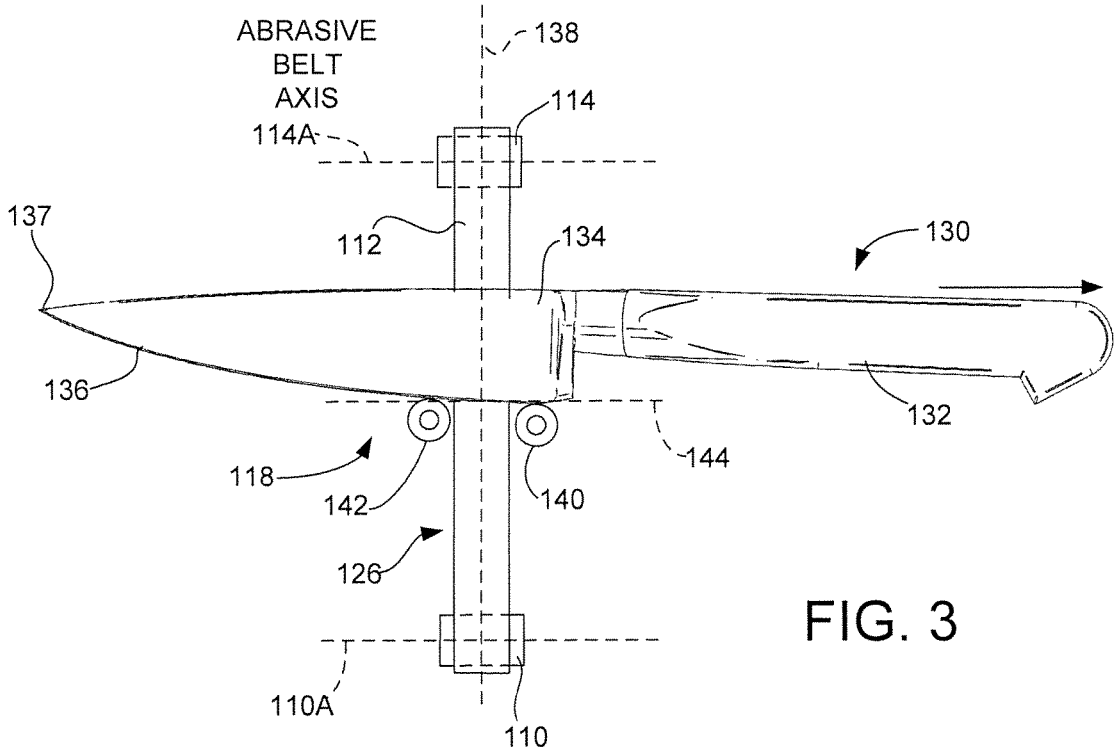
FIG. 3 is a side elevational representation of the sharpener of FIG. 1 in accordance with some embodiments, with FIG. 3 providing a nominally orthogonal tilt angle of a sharpening tool with respect to an abrasive belt of FIG. 1.

FIG. 3 shows aspects of the exemplary sharpener 100 in accordance with some embodiments. A cutting tool 130, in the form of a kitchen (or chef) knife, is presented against the segment 126 of the belt 112 between rollers 110, 114. The knife 130 includes a user handle 132 and a metal blade 134 with a curvilinearly extending cutting edge 136. The cutting edge 136 extends to a distal tip 137 and is formed along the intersection of opposing sides (not numerically denoted) of the blade 134 which taper to a line. Removal, honing and/or alignment of material from the respective sides of the blade 134 produces a sharpened cutting edge 136 along the entire length of the blade.

An abrasive belt axis is represented by broken line 138 and represents a direction of travel and alignment of the belt 112 during operation. The abrasive belt axis 138 is nominally orthogonal to the respective roller axes 110A, 114A of rollers 110, 114 in FIG. 3.

A pair of edge guide rollers are represented at 140, 142. The edge guide rollers form a portion of the aforementioned guide assembly 118 (see FIG. 1) can be made of any suitable material designed to support portions of the cutting edge 136. Other forms of edge guides can be used, including stationary edge guides as discussed below.

Generally, the edge guide rollers 140, 142 provide a retraction path 144 for the blade 134 as the user draws the cutting edge across the belt 112 via the handle 132. As shown in FIG. 3, the retraction path 144 is nominally orthogonal to the abrasive belt axis 138 and is nominally parallel to the respective roller axes 110A, 114A. As taught by the '407 patent, the belt 112 will deflect out of the neutral plane 126 responsive to changes in the curvilinearity of the cutting edge 136 as the user draws the knife 130 across the belt 112. Depending upon such curvilinearity, the user may provide an upward motion to the handle 132 during such retraction to nominally maintain the cutting edge 136 in contact with the respective edge guides 140, 142.

Figure 4:
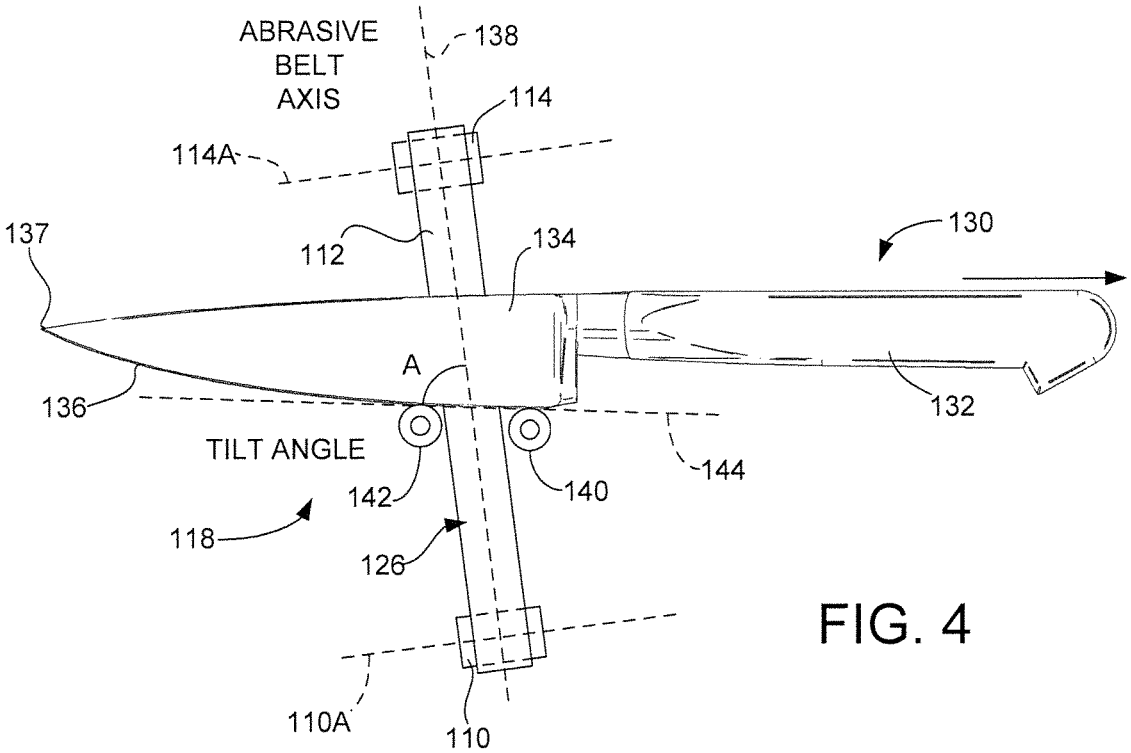
FIG. 4 is a side elevational representation of the sharpener of FIG. 1 in accordance with further embodiments, with FIG. 4 providing an edge guide configuration to impart a nominally non-orthogonal tilt angle to the sharpening tool with respect to the abrasive belt.

FIG. 4 shows another, alternative configuration for the sharpener 100 of FIG. 1. In FIG. 4, the retraction path 144 is non-orthogonal to the abrasive belt axis 138. This defines a tilt angle A therebetween, which depending on the requirements of a given application may be on the order of from about 65 degrees to about 89 degrees.

While not limiting to the scope of the claimed subject matter, the presence of a non-orthogonal tilt angle A as in FIG. 4 can provide more uniform deflection (twisting) of the belt 112 as the belt conforms to the curvilinearly extending cutting edge 136. This generally increases the surface pressure and associated material take off (MTO) rate along the front edge of the belt, that is, that portion of the belt that is closer to the handle. The tilt angle A further reduces the surface pressure and MTO rate along the rear edge of the belt, that is, along that portion of the belt that is closer to the tip of the blade. In this way, a variable surface pressure and MTO rate is supplied across the width of the belt, which provides enhanced sharpening adjacent the handle and less tip rounding as the tip of the blade encounters the belt.

Figure 5:
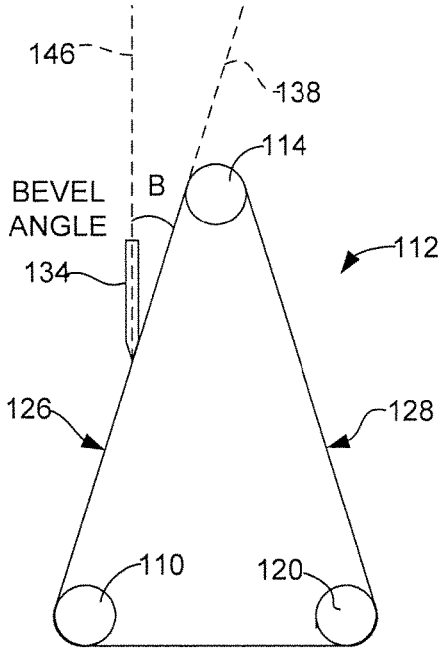
FIG. 5 illustrates a bevel angle imparted by the sharpener of FIG. 3 during a sharpening operation upon a kitchen knife in accordance with some embodiments.

FIG. 5 is an end-elevational view of the orientation of FIG. 3. In FIG. 5, a bevel angle B is defined as an intervening angle between the belt axis 138 and a lateral axis 146 of the blade 134. The lateral axis 146 of the blade passes through the cutting edge 136 (see FIG. 3) in a substantially "vertical" direction normal to the presentation line 144. Any suitable bevel angle can be used, such as, for example, on the order of about 20 degrees. In this context, the term "bevel" generally indicates the angle from vertical (line 146) along which the opposing sides (bevels) of the sharpened blade will generally align. Because of the conformal nature of the belt, the actual sides of the blade may be provided with a slight convex grinding configuration.

Figure 6A:
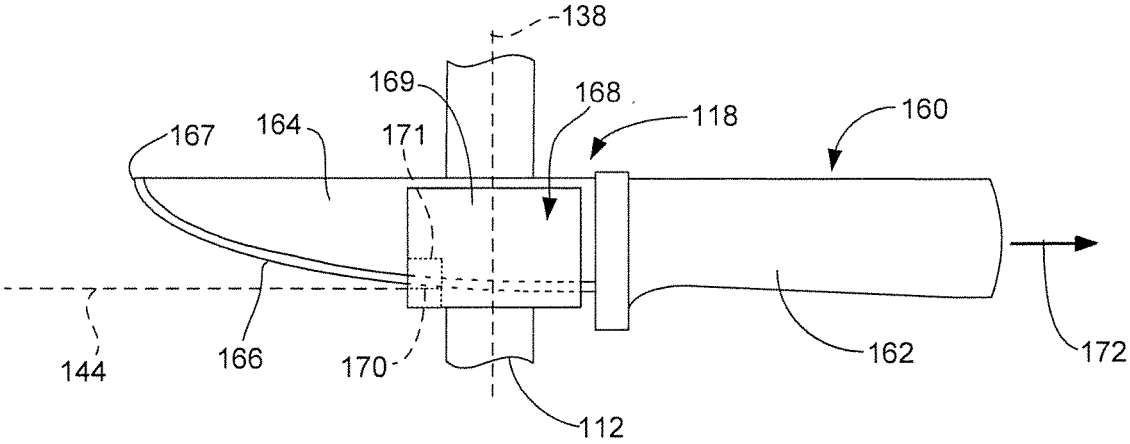
FIG. 6A shows another elevational view of the sharpener of FIG. 3 with another edge guide configuration in accordance with some embodiments.
Figure 6B:
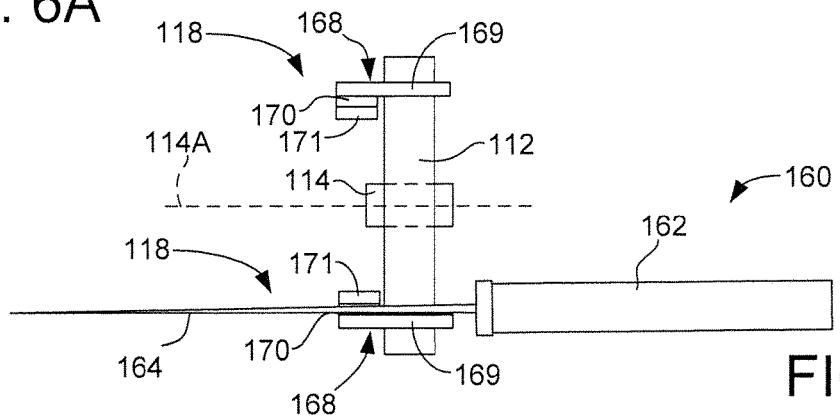
FIG. 6B is a top plan representation of the sharpener of FIG. 6A.

FIGS. 6A and 6B show additional details of the sharpener 100 of FIG. 1 in accordance with some embodiments. Another knife 160 generally similar to the knife 130 of FIGS. 3-5 is shown to include a handle 162, blade portion 164, cutting edge 166 and distal end 167. The blade is shown to be inserted into a guide member 168 of the guide assembly 118 (FIG. 1). The guide member 168 includes opposing side support members 169, 171 with inwardly facing surfaces adapted to enable, through contacting engagement, alignment of the blade 164 nominally at the bevel angle (see FIG. 5) during presentation of the blade against the belt. A stationary edge guide 170 between the side support members 169, 171 provides a stationary edge guide surface against which the user can contactingly engage a portion of the cutting edge 166 during the sharpening operation. FIG. 6B is a top plan view showing two mirror image guide members 168 against respective belt segments 126, 128 (FIG. 2). These respective guide members can be used to effect sharpening operations on opposing sides of the blade 164.

During a sharpening operation, in some embodiments the module 104 (see FIG. 1) is commanded, via user input, to rotate the belt in a first direction and at a first speed. The user presents a cutting tool (such as the exemplary knives 130, 160) in an associated guide assembly 118 (see e.g., FIGS. 3-6B) and retracts the knife thereacross a selected number of times, such as 3-5 times. The user may alternate the sharpening on both sides of the blade using dual guides such as represented in FIG. 6B. This effects a coarse sharpening operation upon the blade.

Thereafter, the user provides an input to module 104, which causes the sharpener 100 to rotate the belt 112 in a second direction and at a second speed. The second direction may be the same as, or opposite of, the first direction. The second speed will be slower than the first speed. Again the user presents the blade via the guide assembly 118 as before, drawing the blade across the belt 112 a selected number of times, such as 3-5 times. As before, the user may alternate the sharpening on both sides of the blade.

As mentioned above, the final direction of sharpening may be selected such that the belt is moving up and across the blade during all or a portion of the fine mode of sharpening (e.g., in a substantially vertical direction toward upper roller 114 as seen in FIG. 5). Sensors and other mechanisms can be used as desired to automatically select the proper direction of sharpening; for example, proximity or pressure sensors in the guide members 168 can be used to detect the location of the blade and select a suitable direction of movement of the belt 112.

The linear stiffness and abrasiveness level (e.g., grit level) of the belt can be selected depending on the requirements of a given application. Without limitation, in some embodiments it has been found that a grit value of from about 80-200 can be selected for the abrasive belt and effective coarse and fine sharpening can be carried out using the same common belt as described herein. In other embodiments, the grit value may be from about 100-400. The respective rotational rates can vary as well; for example, a suitable high speed (coarse grind) rotational rate may be on the order of from about 800-1500 revolutions per minute (rpm) at the rollers and a suitable low speed (fine grind or honing) rotational rate may be on the order of about 300-500 rpm at the rollers.

In further cases, the lower speed may be approximately 50% or lower than 50% of the higher speed. In still further cases, the lower speed may be approximately 75% or lower than 75% of the higher speed. Other suitable values may be used so these are merely exemplary and are not limiting. The speed of the medium may be expressed in any suitable way, including linear travel past the cutting edge (e.g., feet per second, fps, etc.).

As noted above, more than two different speeds, such as three speeds or more, may be used. A high speed may be used initially, followed by a lower, medium speed, followed by a lowest speed lower than the medium speed.

FIG. 7 shows another sharpener 200 constructed and operated in accordance with further embodiments. The sharpener 200 is generally similar to the sharpener 100 discussed above except that the sharpener 200 uses rotatable media (e.g., an abrasive disc) as compared to an abrasive belt. Similar operative concepts are embodied in both sharpeners, as will now be discussed.

The sharpener 200 includes a rigid housing 202, a user switch, power and control circuit module 204, an electrical motor 206, a transfer assembly 208 and a drive spindle 210. As before, these elements cooperate to enable a user to select, via user input, at least two different rotational speeds for the drive spindle 210. In some embodiments, different directions of rotation may also be effected.

The drive spindle 210 supports a rotatable abrasive disc 212. A guide assembly 218 is positioned adjacent the disc 212 to enable a user to present a tool thereagainst during a multi-stage sharpening operation using the same disc 212.

While not necessarily limiting, in some embodiments the abrasive disc 212 may be characterized as a flexible abrasive disc, as shown in FIGS. 8A and 8B. FIG. 8A shows the disc 212 in a non-rotating (rest) position. FIG. 8B shows the disc 212 in a rotational (operating) position. During rotation, centrifugal forces (arrows 222) will tend to cause the flexible disc 212 to arrange itself along a neutral plane.

The flexible disc can be formed of any suitable materials, including the use of abrasive media on a fabric or other flexible backing layer. In some cases, abrasive material may be provided on both sides of the disc; in other cases, the abrasive material will only be supplied on a single side of the disc.

FIG. 8C shows a general representation of the flexible disc 212 in some embodiments in which abrasive layers 214, 216 adhere to opposite sides of a central flexible layer 218 made of a woven cloth material. It is contemplated albeit not necessarily required that each of the abrasive layers 214, 216 share a common grit value (e.g., 80 grit, 200 grit, etc.). While the disc is shown to have a cylindrical (disc) shape, other forms of surfaces can be used including shaped discs with frusto-conical shapes, curvilinearly extending shapes, etc. In further embodiments, the discs can be arranged such that the sharpening occurs against an outermost peripheral edge of the disc rather than a facing surface as denoted in FIGS. 7-8B.

Figure 9A:
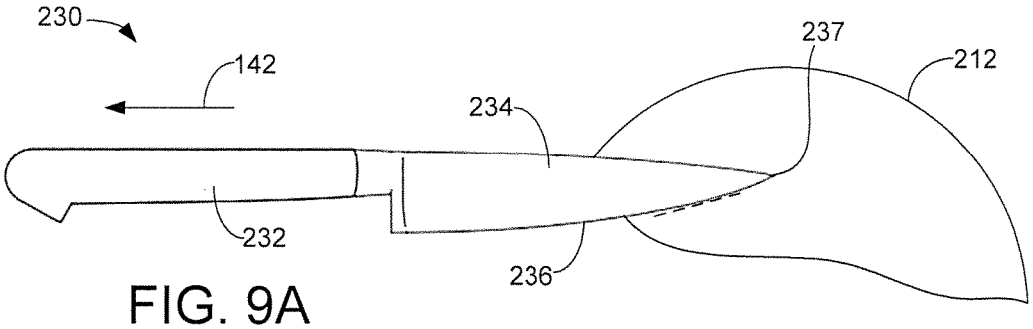
FIGS. 9A-9C show various views of aspects of the sharpener of FIG. 7 to illustrate various tilt, bevel and skew angles imparted to a cutting tool in accordance with some embodiments.
Figure 9B:
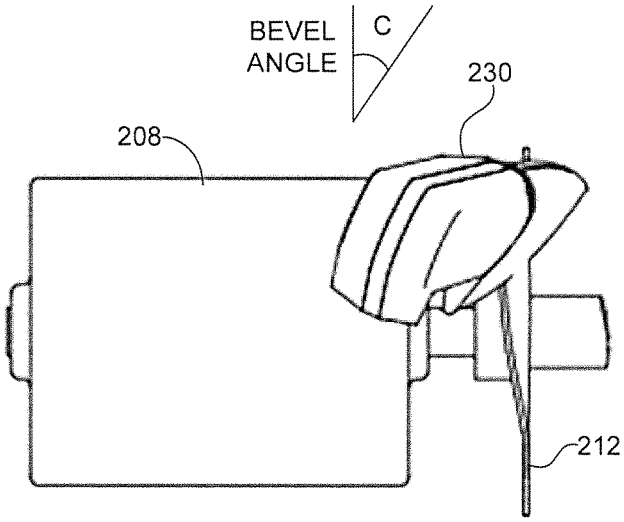
Figure 9C:
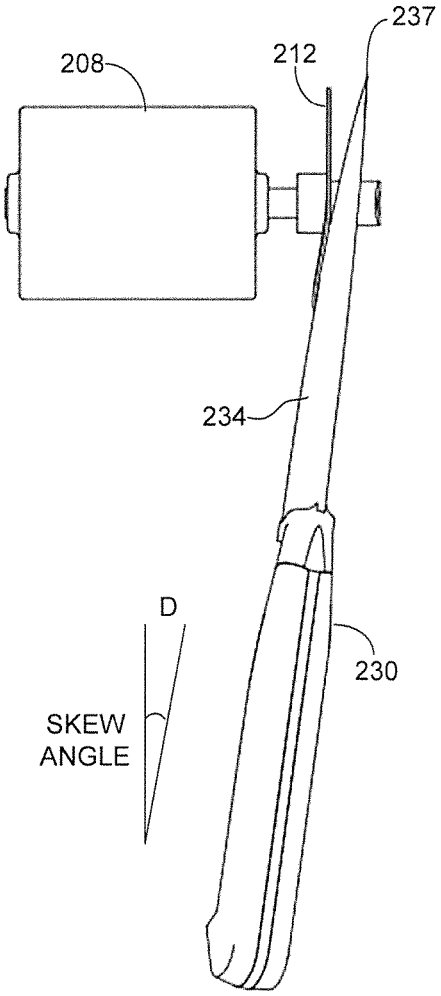

FIGS. 9A-9C show additional views of the flexible abrasive disc 212 of FIGS. 8A-8B. An exemplary tool 230 (kitchen knife) has a handle 232, blade portion 234, cutting edge 236 and distal point 237. The cutting edge 236 is presented against a side of the disc 212 at a suitable geometry to effect a sharpening operation thereon. In the case of a flexible disc, the disc may deform along a standing wave adjacent the cutting edge, as generally denoted in FIGS. 9B and 9C. The blade portion 234 is presented at a suitable bevel angle C (see FIG. 9B) and a suitable skew angle D (see FIG. 9C) as required. A suitable bevel angle may be on the order of about 20 degrees)(C=20° and a suitable skew angle may be on the order of about 5 degrees) (D=5°. Other values can be used.

As before, a multi-stage sharpening operation is carried out using the same rotatable disc 212 by rotating the disc at different effective speeds. A coarse sharpening operation is carried out at a relatively high speed of the disc, followed by a fine sharpening operation carried out at a relatively low speed of the disc. Suitable guides can be provided so that each side of the knife 230 is sharpened using the same side of the disc 212 (such as by presenting the blade 234 in opposite directions against layer 214 in FIG. 8C) or using opposing sides of the disc from the same general direction (such as by presenting the blade 234 against each of the layers 214, 216 in turn).

Figures 10A, 10B, 10C:
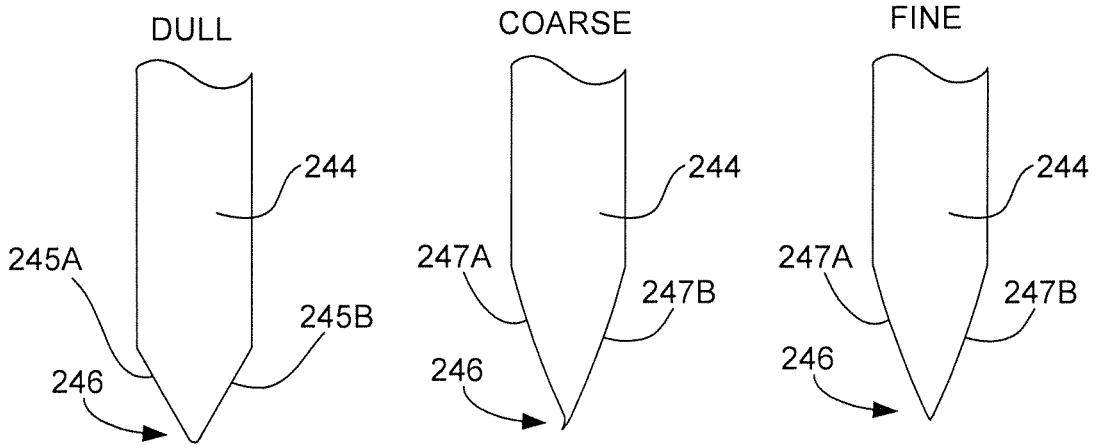
FIGS. 10A-10C show a blade portion of the cutting tool of FIGS. 9A-9C in various states of sharpness.

FIGS. 10A, 10B and 10C are generalized, cross-sectional representations of a portion of a blade 244 to facilitate an explanation of the multi-speed sharpening process. The blade 244 is generally similar to the blade portions of the exemplary knives 130, 160 and 230 discussed above and may constitute the lower edge of a kitchen knife blade.

FIG. 10A represents the blade 244 having a cutting edge 246 in a dull condition that requires sharpening. This may be observed by the rounded nature of the cutting edge. It will be noted that the knife in FIG. 10A was sharpened using a different initial process, such as a flat grinding wheel, etc., to provide opposing, flat beveled surfaces 245A and 245B.

FIG. 10B generally represents the blade 244 in a coarse condition after the application of a first stage of sharpening using a flexible abrasive medium as discussed above (e.g., belt 112, disc 212, etc.). In FIG. 10B, the cutting edge 246 has been refined but includes a burr (e.g., portion of deformed material that extends away from the cutting edge). Opposing convex (e.g., curvilinear) side surfaces 247A and 247B are formed during the belt sharpening process by removing material from the blade.

FIG. 10C generally represents the blade 244 in a fine sharpened condition after the application of a second stage of sharpening. It can be seen in FIG. 10C that the burr has been removed, resulting in a better defined, final geometry for the blade and a sharpened cutting edge 246. Apart from the immediate vicinity of the cutting edge 246, the convex side surfaces 247A and 247B retain nominally the same shape and radius of curvature as in FIG. 10B. The cutting edge 246 thus provides a linear or curvilinearly extending line or edge along which the opposing surfaces 247A and 247B converge.

Figure 10D:
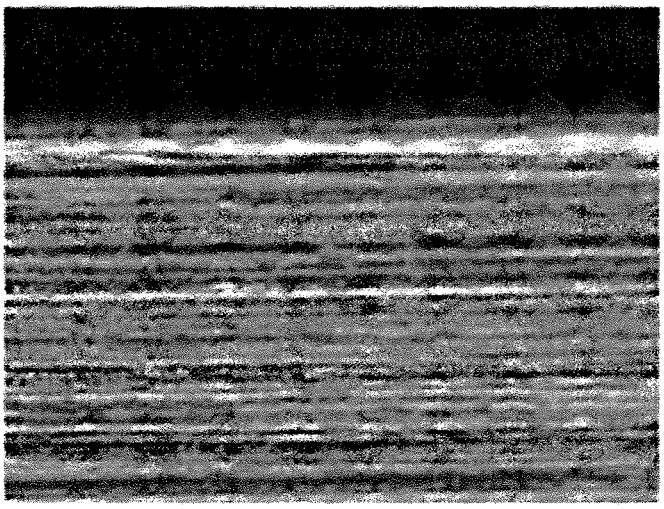
FIGS. 10D-10F show corresponding photographs of an exemplary cutting tool having the various states of sharpness represented by FIGS. 10A-10C, respectively.
Figure 10E:
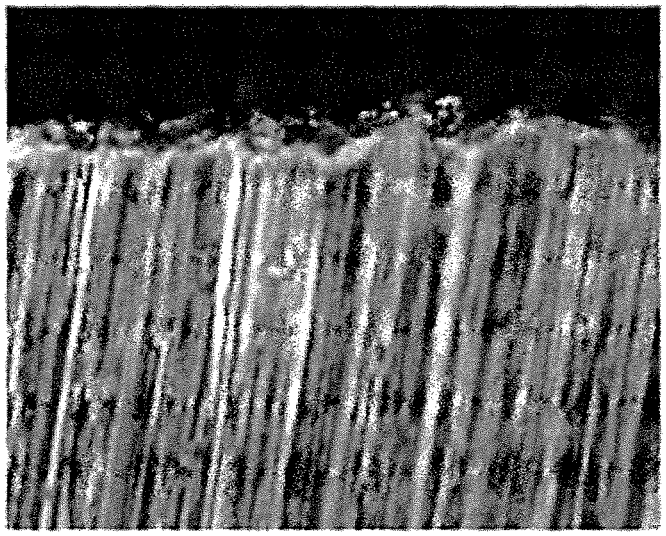
Figure 10F:
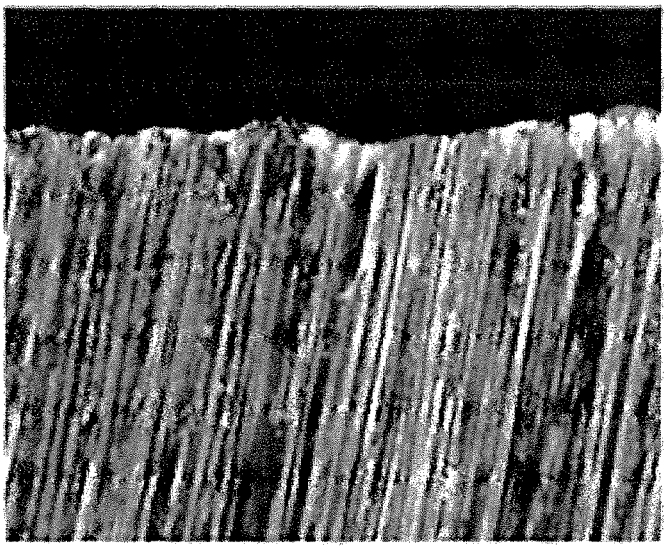

FIGS. 10D, 10E and 10F are photographs of the blade 244 taken during the multi-speed sharpening process discussed herein. The photographs were taken of the same blade under high magnification, such as 500×, although different portions along the cutting edge are represented in each photograph.

FIG. 10D corresponds to FIG. 10A and shows the blade in the initial, dulled condition. FIG. 10E corresponds to FIG. 10B and shows the blade after coarse sharpening has been applied at a higher speed of the abrasive medium. FIG. 10F corresponds to FIG. 10C and shows the blade after the fine sharpening and burr removal has been applied at a lower speed for the medium. It will be appreciated that the views in FIGS. 10D-10F are inverted with respect to FIGS. 10A-10C (e.g., the cutting edge appears near the top in each photo).

The blade in FIG. 10D shows essentially horizontal striations (scratch marks) extending along the length of the blade portion that are substantially parallel to the cutting edge. These may be indicative of a previous sharpening process applied to the blade, or the marks may have been incurred during the use of the blade that resulted in the dulling of the cutting edge. The out-of-focus, indistinct nature of the cutting edge shows that the edge has rolled over or is otherwise rounded off, which prevents the knife from effectively cutting a given material.

FIG. 10E shows a number of striations that extend in a somewhat vertical direction, albeit at a small tilt angle to the right. These striations were imparted during the coarse sharpening operation as the medium was advanced against the cutting edge and the side of the blade at the relatively higher speed. The coarse sharpening led to aggressive material removal, fast shaping and burring; while the side of the blade has been shaped to the substantially curvilinear shape shown in FIG. 10B, the cutting edge remains jagged and has a large number of burrs (distended portions of blade material) that jut up and along the cutting edge.

FIG. 10F shows the blade to have a similar striation pattern as in FIG. 10E, which would be expected since the same presentation angle and same abrasive medium were used during both the coarse and fine sharpening operations. The lower speed of the abrasive medium did not introduce significant amounts of further shaping to the sides of the blade. The lower speed of the abrasive medium did, however, dislodge and remove the burring and other material discontinuities along the cutting edge, resulting in a sharp albeit jagged, or toothy, cutting edge.

It will be appreciated that at least one traditional multi-stage sharpening operations tend to enhance the refinement of the cutting edge, such as through the application of progressively finer abrasives to further refine the cutting edge to the point that it is burr free and substantially linear. While such techniques can provide a very sharp edge, it has been found that such refined edges also tend to dull quickly, sometimes after a single use. As discussed above in FIG. 10D, the very high surface pressures imparted to the very thin, small area cutting edge tend to either erode or curl the refined edge, significantly blunting its cutting performance.

The resulting cutting edge of FIG. 10F, however, retains a measure of toothiness or jaggedness along the length of the cutting edge. The opposing sides of the blade substantially meet along a line as generally represented in FIG. 10C, but this line varies in elevation somewhat along the length. This has been found to provide a cutting edge that not only demonstrates exceptional sharpness, but also has significantly enhanced durability so that the knife remains sharp for a longer period of time. It is believed that the toothy cutting edge shown in FIG. 10F provides very small discontinuities that tend to prevent the cutting edge from folding over along its length as is often experienced with refined edges. Moreover, the toothy cutting edge presents a number of recessed cutting edge portions that retain the initial sharpness even if other, higher elevations portions of the cutting edge have become locally dulled.

Figure 11:
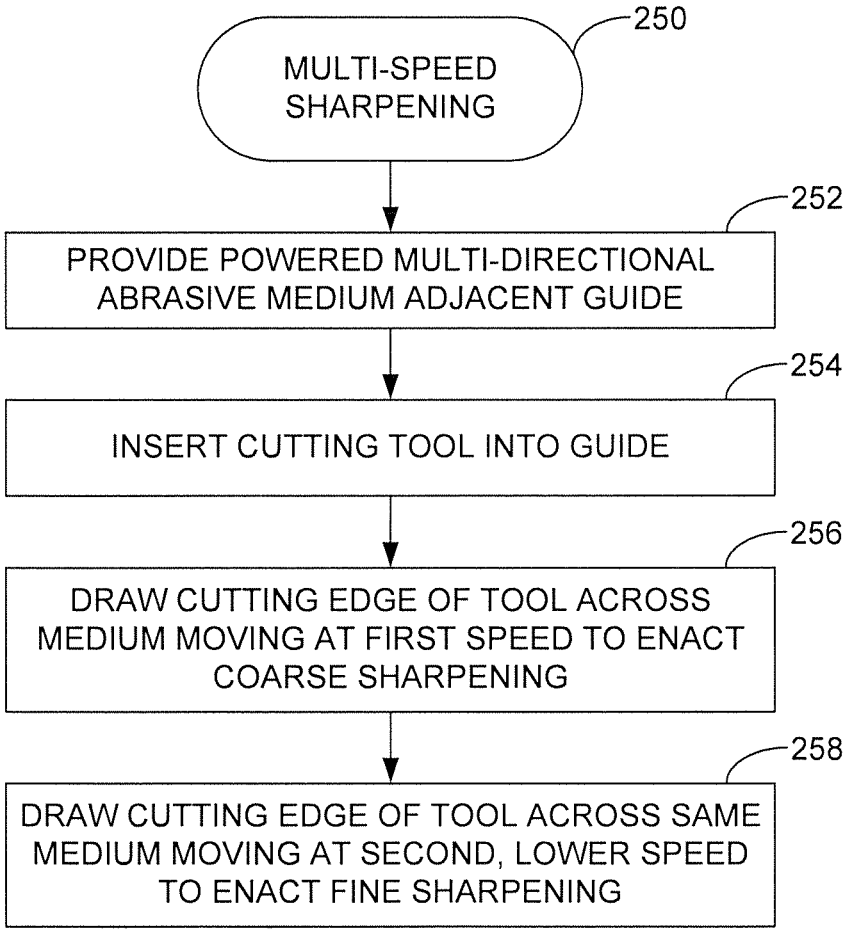
FIG. 11 is a flow chart for a multi-speed sharpening routine carried out in accordance with various embodiments.

FIG. 11 is a flow chart for a multi-speed sharpening routine 250 illustrative of steps that may be carried out to perform the multi-speed sharpening discussed above and generate a sharpened cutting edge such as represented in FIG. 10F. It will be appreciated that the routine applies to the respective sharpeners 100, 200 as well as other sharpeners configured to have a moveable abrasive surface. FIG. 11 is provided to summarize the foregoing discussion but it will be understood that the various steps in FIG. 11 are merely exemplary and can be altered, modified, appended, performed in a different order, etc., depending on the requirements of a given application.

As shown by step 252, a powered multi-directional abrasive medium is provided along with an adjacent guide assembly, such as discussed above for the abrasive belt sharpener 100 of FIG. 1 and the abrasive disc sharpener 200 of FIG. 7.

A user presents a cutting tool for sharpening into the guide assembly at step 254, such as the exemplary knives 130, 160 and 230 discussed above. It will be appreciated that other forms of cutting tools can be utilized in accordance with the routine.

The user draws the cutting edge of the tool across the medium while the medium is moving at a first speed, step 256. As discussed above, this can be carried out multiple successive times, including passes on opposing sides of the cutting tool. It is contemplated that the guide assembly includes at least a first surface that supports a side surface of the blade opposite the medium to establish a desired bevel angle for the sharpening operation that can be repeated through reference to this side surface.

A plunge depth of the cutting edge can further be established through the use of one or more stationary or rotatable edge guides against which a portion of the cutting edge contactingly engages as the blade is drawn across the medium. The operation of step 256 will produce a coarse shaped cutting edge such as exemplified in FIG. 10B.

As shown by 258, once the coarse sharpening operation is completed, the user subsequently draws the cutting tool across the same medium, this time moving at a different second relative speed with respect to the tool. As discussed above, this can be carried out including by providing a suitable input to a motor or other mechanism to slow down the linear or rotational movement rate of the medium with respect to the tool. This effects a fine shaped cutting edge such as exemplified in FIG. 10C.

Figure 12:
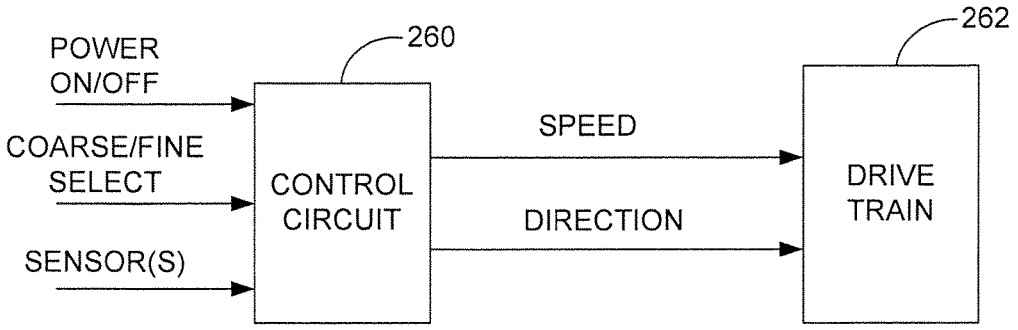
FIG. 12 is a functional block diagram of a control circuit operative to adjust a speed of a drive train affixed to the medium in accordance with some embodiments.

FIG. 12 is a functional block diagram illustrating further aspects of the respective sharpeners in accordance with some embodiments. A control circuit 260 (which may include aspects of the respective modules 104, 204 discussed above) can receive and process various input values including a power on/off value, a coarse/fine select value and values from one or more sensors. In response, the control circuit 260 is configured to output various control values to a drive train (assembly) module 262, which can correspond to the various elements including the motors 106/206, transfer assemblies 108/208 and drive pulley/spindles 110, 210. The control values ultimately establish the speed and direction of the associated medium affixed to the drive train.

In some embodiments, different speeds and directions may be effected through the application of different control voltages and/or currents to the motor. In other embodiments, different gearing ratios or other linkage configurations may be effected via the transfer assemblies. As noted above, user selectable switches, levers or other input mechanisms can be utilized to generate the various input values. In some cases, the user can place the system in coarse or fine mode, and then proximity switches can be utilized to determine placement of the tool into the associated guide and a suitable movement direction for the medium can be selected accordingly.

Figure 13:
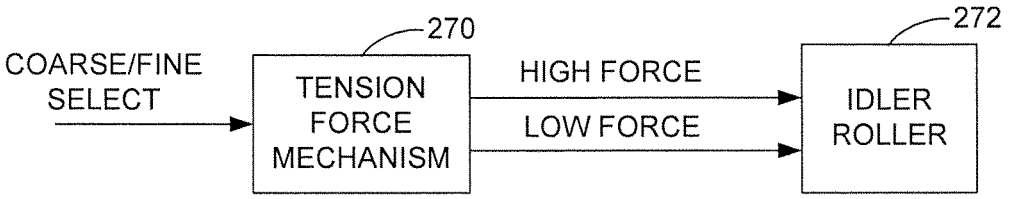
FIG. 13 is a functional block diagram of a tension force adjustment mechanism that supplies different output tension forces to an idler roller affixed to the medium in accordance with some embodiments.

FIG. 13 is a functional block representation of another mechanism useful in accordance with some embodiments. FIG. 13 includes a tension force mechanism 270 in conjunction with an idler roller 272 or other mechanism. In FIG. 13, a coarse/fine select value is input to the tension force mechanism 270, which in turn applies either a relatively high tension force or a relatively low tension force to the idler roller 272.

Such changes in tensioner bias forces can be provided in addition to, or in lieu to, the changes in rotational/movement rate of the medium. It will be appreciated that the changes in the respective surface pressures of the medium effect the generation of the burr and relatively large scale shaping of the coarse grind, and the fine grind operation (at low pressure) sufficient to remove the burring and produce the final desired geometry. Accordingly, further embodiments can utilize other mechanisms apart from speed control to effect higher and lower amounts of surface pressure to achieve the disclosed coarse and fine shaping using the same medium.

Figure 14:
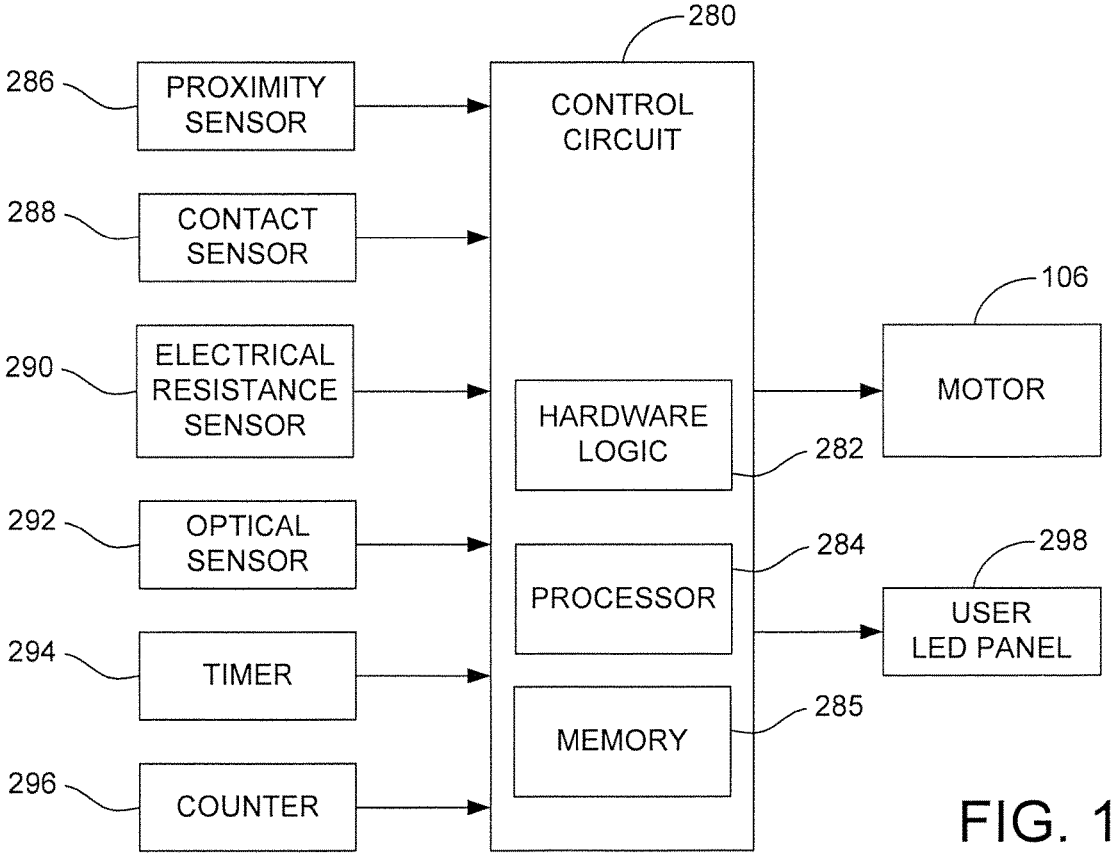
FIG. 14 is another functional block diagram of a control circuit in conjunction with a number of alternative sensors that may be used to control a multi-speed sharpening process.

FIG. 14 shows another functional block diagram of a control circuit 280 that may be incorporated into the various powered sharpeners discussed herein, including the belt sharpener 100 of FIG. 1 and the disc sharpener 200 of FIG. 7. The control circuit 280 may be hardware based so as to include various control gates and other hardware logic, as represented at block 282, to carry out the various functions described herein. Additionally or alternatively, the control circuit 280 may include one or more programmable processors 284 that utilize programming steps stored in an associated memory device 285 to carry out the variously described functions.

A number of different types of sensors and other electrically based circuit elements can be arranged as required to supply inputs to the control circuit 280. These can include one or more of a proximity circuit 286, a contact sensor 288, an electrical resistance sensor 290, an optical sensor 292, a timer 294 and/or a counter circuit 296. Control outputs from the control circuit are directed to the electrical motor 106, as well as a user light emitting diode (LED) panel 298. While each of these elements shown in FIG. 14 may be present in a single embodiment, it is contemplated that only selected ones of these elements will be present and incorporated into a given device.

The various sensors can be used to detect operation by the user to contact and draw the cutting tool across the medium. It is contemplated that the various sensors may be respectively placed in suitable locations, such as integrated within or adjacent to the guides 168 (see FIGS. 6A-6B). In some cases, the sensors may be used to measure, or count, the number of sharpening passes applied by a user during a sharpening operation. Other ones of the sensors may be adapted to monitor changes in the cutting tool itself during the sharpening operation, thereby providing an indication of the progress and effectiveness of the sharpening operation.

While these and other types of sensors are well known in the art, it will be helpful to give a brief overview of each type. The proximity sensor 286 may take the form of a Hall effect sensor or similar mechanism configured to sense the adjacent proximity of the cutting tool, such as through changes in the field strength of a magnetic field that encompasses portions of the cutting tool as the tool is moved through the guide. The contact sensor 288 may utilize a pressure activated lever, spring, pin or other member that senses the application of contact imparted by a portion of the cutting tool.

The electrical resistance sensor 290 may establish a low current pathway that can be used to detect changes in electrical resistance of the cutting tool. The sensor may form a portion of the edge guide surface (see e.g., surface 170 in FIGS. 6A-6B) against which the cutting edge is drawn. If an injection molded plastic is used to form the guide, carbon or other electrically conductive particles may be intermixed with the plastic to enable such measurements. The optical sensor 292 may take the form of a laser diode or other electromagnetic radiation source that impinges a portion of the cutting edge. A receiver may be positioned to measure magnitude or other characteristic of the reflected light to assess a condition of, or changes to, the cutting edge. For example, continued refinement of the cutting edge through the removal of burrs and other distended material has been found to enhance the reflectivity of the cutting edge.

The timer 294 may take the form of a resettable countdown timer that operates to count to a desired value to denote desired elapsed time intervals. The counter 296 may be a simple incremental buffer or other element that enables a running count of operations, such as sharpening strokes, to be accumulated and tracked. The user LED panel 298 may provide one or more LEDs or other identifiers that provide a visual indication to a user to carry out various operations.

As noted above, one or more sensors such as depicted in FIG. 14 can be utilized during the sharpening process. In one example embodiment, the initial sharpness of a blade is evaluated and determined in response to the user first inserting the blade into the sharpener guide assembly. The control circuit selects an initial speed for the abrasive medium best suitable to address the initial sharpness level of the blade. Detecting a relatively dull (and/or damaged) blade may cause the control circuit to select a higher initial speed to provide a faster material removal rate. Detecting a relatively sharper blade requiring only a small amount of honing may cause the control circuit to select a lower initial speed to provide more controlled shaping of the cutting edge.

A greater or lesser number of speeds may be selected based on the initial condition of the blade so that the control circuit generates a unique sharpening sequence. The condition of the blade may also be monitored by the sensor(s) with the control circuit changing from one speed to the next as appropriate to continue the sharpening process.

In still further embodiments, a sharpness tester device is contemplated that utilizes selected combinations of the various elements in FIG. 14, such as the control circuit 280, one or more of the sensors/circuits 286-296 and the user LED panel 298 (or other user indicator). As before, the sharpness tester device would operate to detect the then-existing sharpness level of a given blade upon insertion of the blade into an appropriate slot or other mechanism. Instead of operating the motor to achieve a particular velocity for the abrasive, however, the sharpness tester can provide an output indication of the sharpness level to the user based on the detected state from the sensor(s). This may allow the user to perform some other sharpening process, including one that does not involve moving abrasive media, should the sensor(s) determine a less than threshold level of sharpness is present.

Figure 15A:
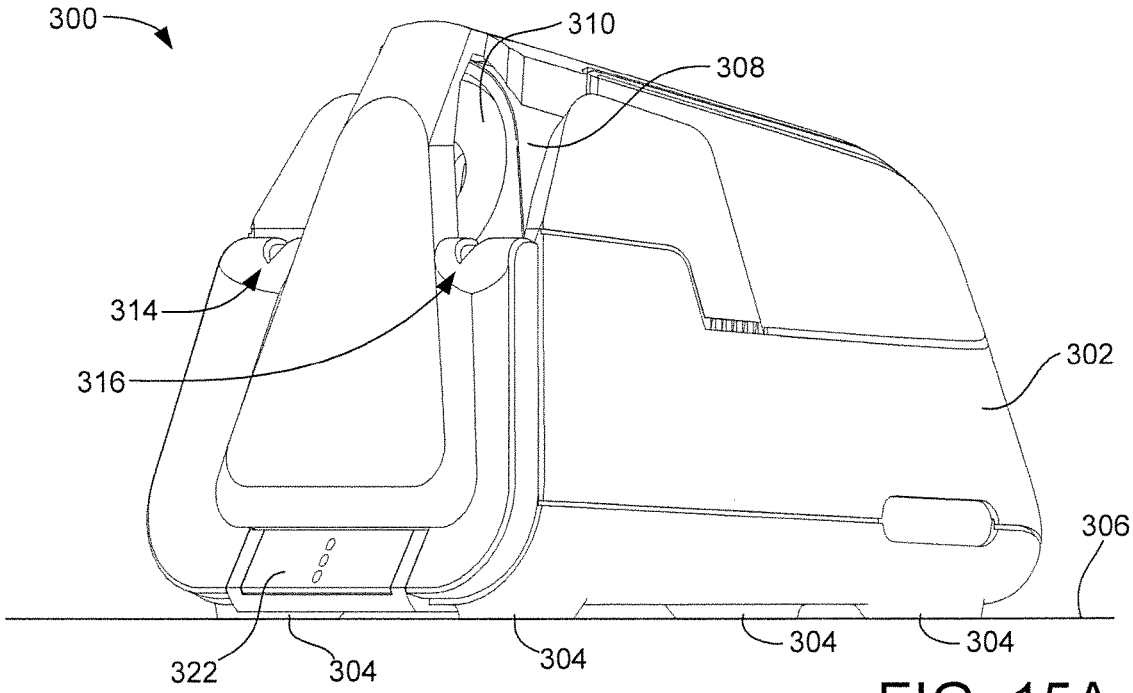
FIGS. 15A and 15B show respective views of a multi-speed abrasive belt sharpener in accordance with further embodiments.
Figure 15B:
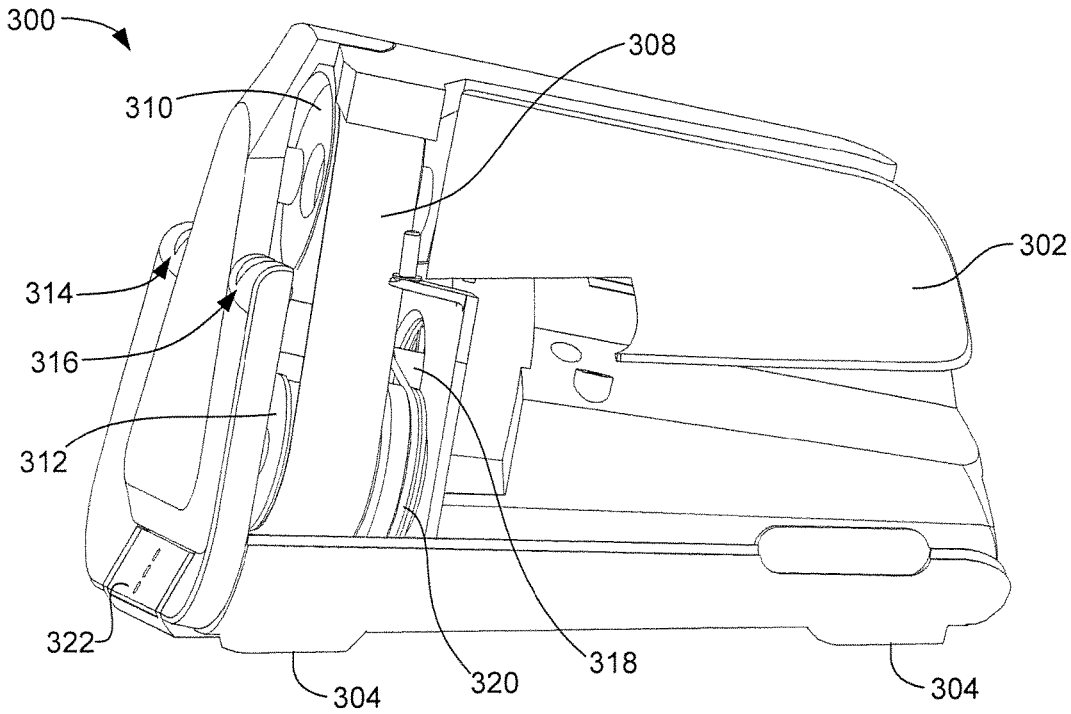

FIGS. 15A and 15B provide isometric views of a multi-speed abrasive belt sharpener 300 in accordance with further embodiments. FIG. 15A is an isometric view of the sharpener 300 from one vantage point, and FIG. 15B is an isometric view of the sharpener 300 from another vantage point and is partially cutaway to show selected interior components of interest.

Generally, the sharpener 300 is similar to the sharpener 100 discussed above and includes a multi-speed abrasive belt arranged along a triangular belt path that passes over three internally disposed rollers, in a manner similar to that discussed above in FIG. 2A. The belt path is tilted backward away from the user at a selected non-orthogonal angle with respect to the horizontal direction, as generally represented in FIG. 4. An internal motor rotates the belt along the belt path, and includes an output drive shaft that is parallel to the roller axes and non-parallel to the horizontal direction. Guide assemblies (guide slots) are arranged on opposing sides of the belt, similar to the guides depicted in FIGS. 6A and 6B, to enable double sided sharpening operations upon a cutting tool. Each of the guide slots may have front and rear stationary edge guide surfaces such as 170 located on opposing sides of the belt in a manner similar to the roller edge guides 140, 142 in FIG. 4. Various control circuitry such as depicted in FIGS. 12-14 may be incorporated into the sharpener, as discussed more fully below.

With specific reference to FIGS. 15A and 15B, a rigid housing 302 encloses various elements of interest such as the motor, transfer assembly, rollers, control electronics, etc. Base support contact features (e.g., pads) 304 extend from the housing 302 and are aligned along a horizontal plane to rest on an underlying horizontal base surface 306, such as a table top, etc.

An endless abrasive belt 308 is routed along a plurality of rollers, including an upper idler roller 310 and a lower right drive roller 312. Opposing guide slots 314, 316 operate to enable a user to carry out slack-belt sharpening on opposing distal extents of the belt. An interior motor drive shaft 318 transfers rotational power to the drive roller 312 via a drive belt 320. A number of user visible LEDs are provided on a user LED panel 322 in front of the sharpener, which may be selectively activated during a sharpening sequence.

Figure 16:
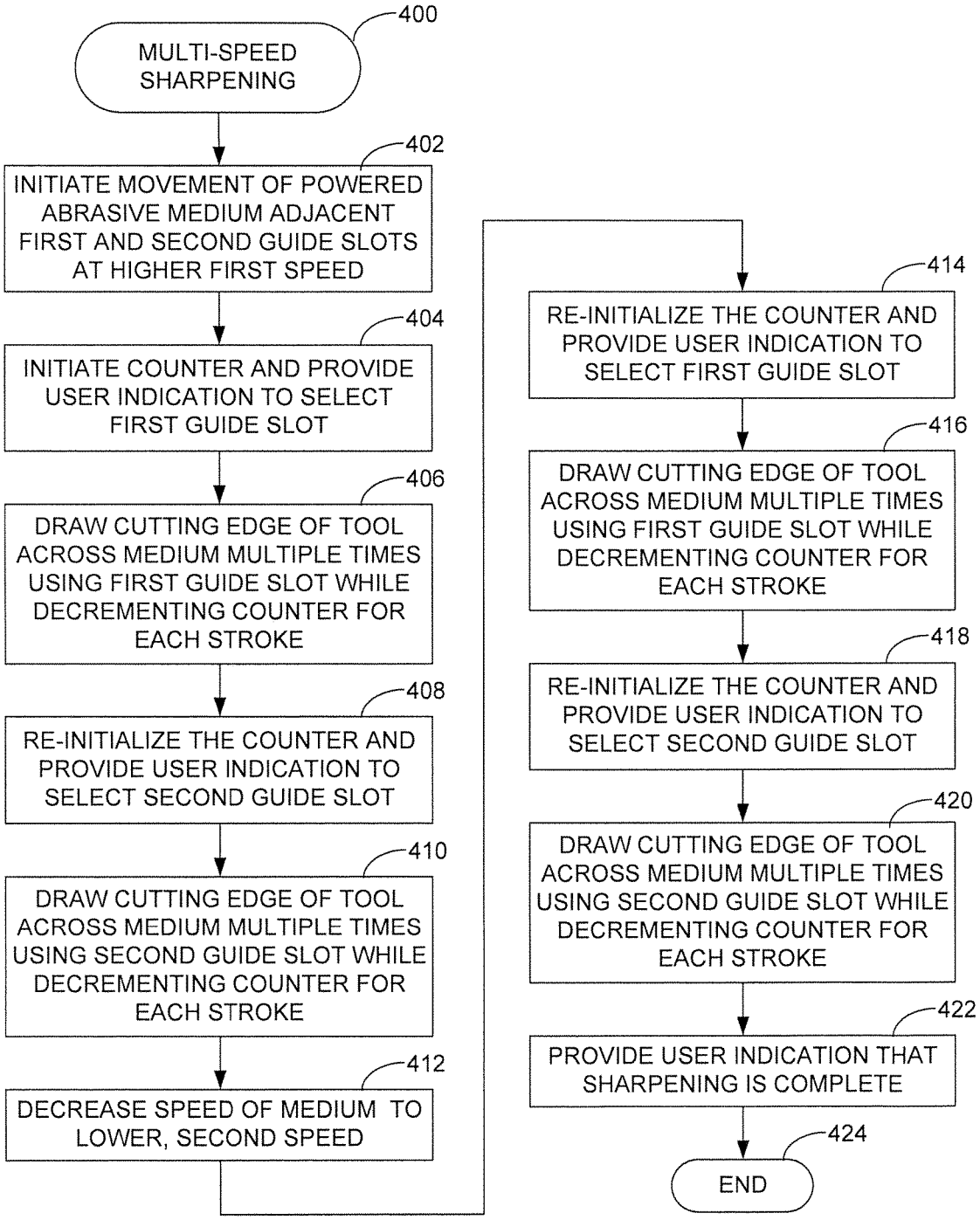
FIG. 16 is a flow chart for a multi-speed sharpening operation carried out by the sharpener of FIGS. 15A and 15B in accordance with some embodiments.

FIG. 16 is a flow chart for a multi-speed sharpening process 400 carried out in accordance with some embodiments to sharpen a cutting tool (in this case, a kitchen knife). The present discussion will contemplate the process is carried out using the sharpener 300 of FIGS. 15A-15B, using selected sensors and control circuits from FIG. 14 and opposing guide slots. This is merely exemplary and is not limiting, as other embodiments can omit or modify these elements as required, including the use of a single guide slot.

As shown by step 402, the process begins with initiated movement of a powered abrasive medium (e.g., the belt 310) in a selected direction at a first, higher speed. This may be carried out by the user activating the sharpener or by some other action on the part of the user. The belt is arranged adjacent first and second guide slots, such as the guides 314, 316, which are adapted to support the knife during a double sided sharpening operation.

At step 404, the counter 296 is initialized and, as desired, a user indication is made to signal the user to place the knife in the first guide slot. This may be performed in a variety of ways, such as flashing or solid colored LEDs adapted for this purpose. In one embodiment, one LED may be placed under each slot to signal to the user which slot to use in turn.

The user proceeds at step 406 to draw the cutting edge of the knife across the moving medium multiple times to carry out a coarse sharpening operation to a first side of the knife in a manner as discussed above. In FIG. 16, the sharpener uses a sensor, such as a contact sensor, pressure sensor, optical sensor, tension sensor, etc. to detect the number of strokes applied by the user in the first slot, and increments (or decrements) the counter in response to each stroke. This provides an accumulated count value as the total number of strokes that have been applied, and this accumulated count value may be compared to a predetermined threshold level. In this way, a predetermined desired number of strokes, such as 3-5 strokes, can be applied.

At step 408, the counter is reinitialized and, as desired, a second user indication may be supplied to signal the user to use the second slot. This can be carried out by a different LED or by some other mechanism. It will be appreciated that the use of user indications such as LEDs is merely exemplary and helps to make the sharpening process user-friendly, repeatable and effective. Nevertheless, such user indications are not necessarily required.

At step 410, the user places the knife into the second slot and repeats the coarse grinding operation to the second side of the blade. As before, sensors may be used to detect each stroke and the counter is used to accumulate the total number of strokes applied, after which the system signals the completion of the coarse part of the sharpening process.

The system next operates at step 412 to reduce the speed of the medium to a second, lower speed. As noted above, a first roller rpm rate may be on the order of around 1000 rpm during the coarse sharpening, and this rate may be reduced to around 500 rpm during the fine sharpening operation. Other values may be used.

To carry out the fine sharpening, the foregoing steps are largely repeated at the lower speed. The counter is re-initialized and, as desired, the user is directed to once again place the knife in the first guide slot at step 414. As before, the user draws the tool through the first guide slot the predetermined number of times, as indicated by the counter, step 416. These steps are repeated for the second guide slot at steps 418 and 420, after which the sharpener provides an indication to the user that the sharpening operation is completed at step 422, such as by powering down or some other operation, and the process ends at step 424.

A number of variations may be enacted to the routine of FIG. 16. In one embodiment, the timer circuit (e.g., 294, FIG. 14) is enacted for a desired elapsed period of time for each side. For example, the timer may be set to a suitable value, such as 30 seconds, and a light or other indicator signals the user to repetitively draw the knife through one of the guides so long as that light is still activated. At the end of the 30 seconds, another light comes on, signaling the user to switch to the other guide and repeat. The sharpener may automatically reduce the speed of the belt, and then signal the foregoing operations again in each slot. This presents an extremely easy to use sharpener that provides superior sharpening results.

Finally, it is contemplated that the medium (belt 310) in the routine of FIG. 16 moves in a common direction during the entirety of the routine. In further embodiments, changes in direction of the belt (or other medium) may be selectively carried out as desired. For example, the belt direction may alternately change so that the belt moves downwardly on each side during the coarse sharpening operation, and moves upwardly on each side during the fine sharpening operation.

Figure 17:
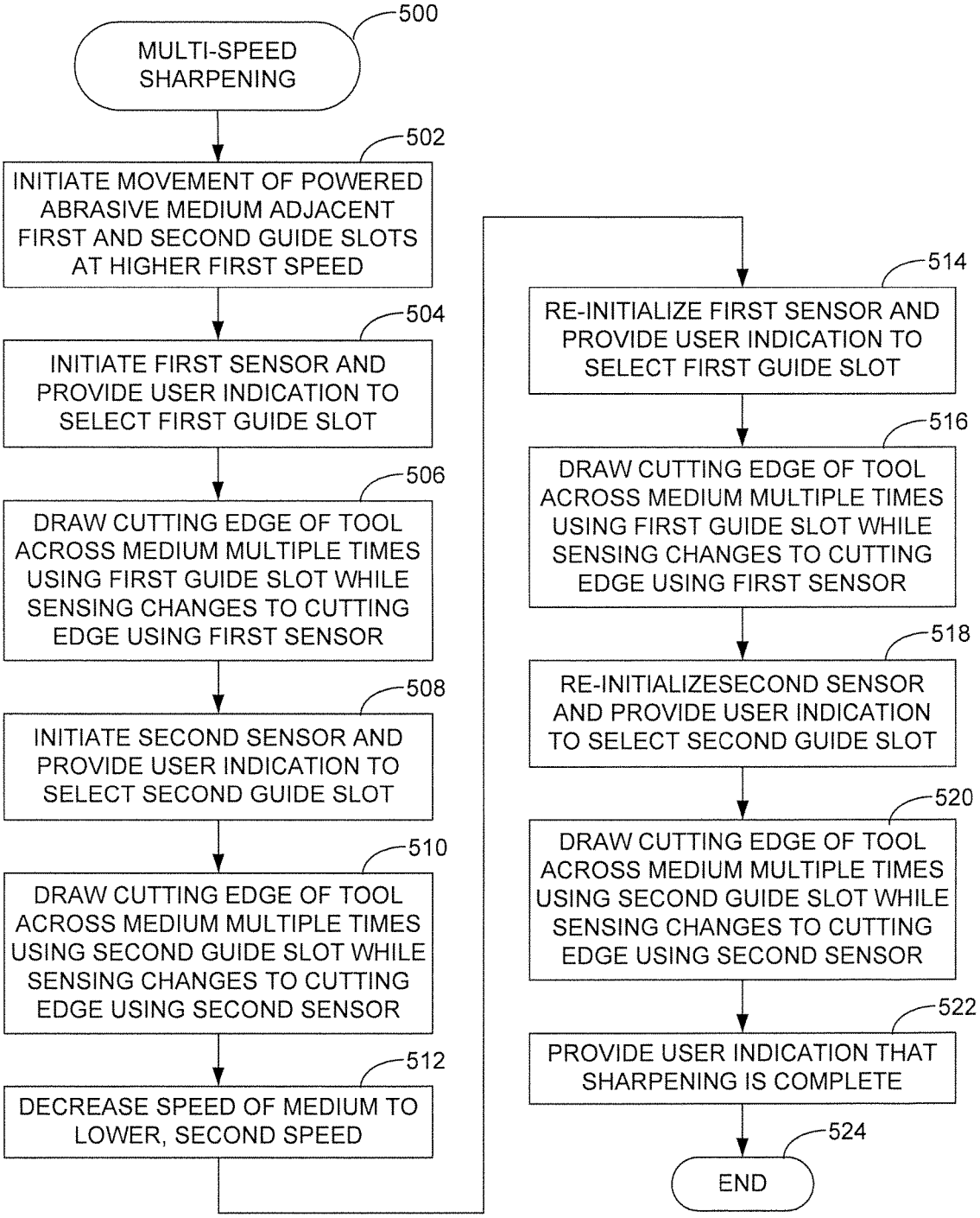
FIG. 17 is a flow chart for a multi-speed sharpening operation carried out by the sharpener of FIGS. 15A and 15B in accordance with other embodiments.

FIG. 17 shows another multi-speed sharpening routine 500 that is similar to the routine 400 in FIG. 16. The routine 500 is also contemplated as being carried out by the sharpener 300 in accordance with some embodiments to provide a toothy sharpened edge such as shown in FIG. 10F. In FIG. 17, the sharpener 300 is configured with one or more sensors that sense the state of the cutting edge during the sharpening process, such as but not limited to the aforementioned electrical resistance or optical sensors.

As before, the process begins at step 502 with the initialization of movement of the abrasive medium (e.g., belt 310) at a first, higher speed. A first sensor is initiated at step 504 and, as desired, the user is signaled to use the first guide slot, step 504. The user proceeds to draw the knife through the first slot at step 506 while the sensor monitors the sharpening process. In this way, a variable number of strokes through the first slot may be provided based on changes made to the cutting edge. The settings used by the sensor may be obtained empirically through evaluation of a number of different cutting tool sharpening characteristics.

A second sensor is initiated at step 508 and the user proceeds to draw the knife through the second slot at step 510. The second sensor monitors the sharpening process to detect changes in the cutting edge. This provides an adaptive sharpening process based on the rates of material removal for the blade, and may provide better overall sharpening results for a large variety of cutting tools with various levels of damage, dullness, etc.

Once the higher speed coarse sharpening operation is completed, the sharpener decreases the speed of the medium to the lower speed at step 512. The foregoing steps are repeated for the lower speed, fine sharpening operation at steps 514, 516, 518 and 520. As before, once the fine sharpening operation has been performed, a user indication is provided to signal that the sharpening operation is completed, step 522, and the process ends at step 524.

It follows that various embodiments can be characterized as directed to a single stage powered sharpener with a moveable abrasive surface adapted to carry out multi-stage sharpening on a cutting tool. The system can include a relatively coarse abrasive surface (such as a grit from 80-200), a pair of opposing guides, and a drive system for the abrasive surface with respective first and second speeds to effect the different first and second rates of material removal. In some embodiments, the second speed of the material (as measured with respect to the associated guide) can be any suitable speed, such as less than or equal to about 500 surface feet per minute. The first speed is greater than the second speed, such as greater than or equal to about two (2) times the second speed. Other suitable speed ratios can be used.

A two speed sharpening process can include placing the blade of the cutting tool to be sharpened into a first guide against a first guide surface and a first edge stop. The first guide surface can extend at a selected bevel angle, and the first edge stop can be arranged at a selected distance from the abrasive surface. The abrasive surface can be controlled to advance at a first speed. The blade is drawn across the abrasive surface, multiple times in succession as needed, to remove material from the blade and to impart a selected bevel surface on the first side of the blade. It is contemplated that this first operation will also generate a burr on an opposing second side of the blade.

The blade can be placed into a second guide against a second guide surface and a second edge stop. The second guide surface can extend at the selected bevel angle and the second edge stop can be the selected distance from the abrasive surface. The abrasive surface is controlled to advance at a second, lower speed. The user draws the blade across the abrasive surface, multiple times in succession as needed, to remove material from the blade such that the burr is removed and the final geometry is achieved.

Optional parameters for the foregoing can include the first and second guides being the same guide, or different guides. If the first and second guides are the same guide, the blade is inserted at different orientations so that the first side is presented to the abrasive surface in the first orientation and the second side is presented in the second orientation at the same bevel angle. This may be accomplished, for example, by flipping the handle of the tool end to end to reverse the direction of the blade through the guide.

In cases where the first and second guides are different guides, the guides may be placed on opposing sides of the abrasive and the blade is inserted in the first guide at a first bevel angle to the abrasive surface and the blade is subsequently inserted into the second guide at a second bevel angle. The first and second bevel angles may be the same and may extend, for example, over a range of from about 10 degrees to about 25 degrees.

As noted above, the abrasive surface may extend on a flexible belt routed along a path having two or more rollers, one of which is driven by a drive system with an electric motor. Alternative, the abrasive surface may extend on one or more flexible discs driven by an electric motor.

The abrasive surface may be spring biased to allow it to impart a selected force to the blade as it is displaced by the blade inserted against the first or second guides. In various cases, the force between the blade and surface in the first guide is equal to the force in the second guide, or greater than the force in the second guide. In some cases, the abrasive surface is a flexible belt and the spring bias on the belt is between about 2 and 12 pounds. Deflection of the abrasive surface away from a neutral plane may occur in the range of from about 0.04 inches, in. and about 0.25 in.

It will be recognized by the skilled artisan in view of the present disclosure that the flexibility of the associated medium (e.g., flexible disc, flexible belt) provides different surface pressures to the associated cutting tool based on changes in speed of the abrasive. It is believed that a faster speed of the abrasive may tend to generally impart greater inertia and/or structural rigidity to the medium (such as through centrifugal forces) so that greater rates of material removal are obtained at the faster speeds of the media. The slower speed of the media is generally selected such as to be fast enough to remove any burring but slow enough so as to not otherwise significantly change the geometry of the blade. The actual speeds will depend on a variety of factors including different blade geometries, abrasiveness levels, abrasive member stiffness and mass, etc., and may be empirically determined. A sharpener may be provisioned with multiple available speeds and the user selects the appropriate speeds based on various factors. A final honing stage, such as an abrasive rod or other stationary abrasive member, can be further provided to provide final honing of the final cutting edge.

It is to be understood that even though numerous characteristics and advantages of various embodiments of the present disclosure have been set forth in the foregoing description, together with details of the structure and function of various embodiments, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. A sharpener for sharpening a cutting tool having a cutting edge, comprising:

a moveable abrasive medium having an abrasive surface;

a guide assembly adjacent the abrasive medium configured to support a cutting tool thereagainst;

a drive assembly configured to move the abrasive medium with respect to the guide assembly responsive to a control input value; and a control circuit configured to provide a first control input value to move the medium at a first speed relative to the guide assembly during a coarse sharpening operation in which a user presents the cutting tool against the medium using the guide assembly to shape a side of the cutting tool and generate distended material from the cutting edge, and to subsequently provide a second control input value to transition the medium from the first speed to a lower second speed relative to the guide assembly during a fine sharpening operation in which the user presents the cutting tool against the medium using the guide assembly to remove the distended material and provide a sharpened cutting edge.

2. The sharpener of claim 1, wherein the drive assembly comprises an electric motor and a transfer assembly to transfer mechanical torque generated by the motor to the medium.

3. The sharpener of claim 1, wherein the abrasive medium is an endless abrasive belt.

4. The sharpener of claim 1, wherein the abrasive medium is a rotatable abrasive disc.

5. The sharpener of claim 4, wherein the rotatable abrasive disc is a flexible abrasive disc, wherein centrifugal forces during rotation of the disc place the disc in a neutral plane.

6. The sharpener of claim 1, wherein the guide assembly comprises at least one stationary edge guide configured to contactingly engage a portion of the cutting edge of the tool during presentation thereof against the medium.

7. The sharpener of claim 1, wherein the guide assembly comprises at least one rotatable edge guide configured to rotatingly engage a portion of the cutting edge of the tool during presentation thereof against the medium.

8. The sharpener of claim 1, wherein the control circuit further directs the transfer assembly to move the medium in a first direction with respect to the guide assembly during the coarse sharpening operation and directs the transfer assembly to move the medium in an opposing, second direction with respect to the guide assembly during the fine sharpening operation.

9. The sharpener of claim 1, further comprising a sensor adjacent the guide assembly, the sensor configured to sense a presence of the cutting tool within the guide assembly in contact with the abrasive medium.

10. The sharpener of claim 9, wherein the control circuit further comprises a counter circuit configured to accumulate a count value comprising a total number of successive strokes of the cutting tool through the guide assembly and against the belt by the user while the medium is moved at the first speed, and wherein the control circuit outputs the second control input value to move the medium at the second, lower speed responsive to the accumulated count value reaching a predetermined threshold value.

11. The sharpener of claim 9, wherein the sensor is configured to detect a change in a characteristic of the cutting edge during the coarse sharpening process, and the control circuit transitions the medium from the first speed to the second speed responsive to the sensor.

12. The sharpener of claim 1, wherein the control circuit further comprises a timer circuit configured to denote a predetermined elapsed time interval, wherein the control circuit outputs the second control input value to transition the medium from the first, higher speed to the second, lower speed responsive to the timer circuit indicating a conclusion of the predetermined elapsed time interval.

13. The sharpener of claim 1, wherein the guide assembly is characterized as a first guide assembly adjacent a first side of the abrasive medium, the sharpener further comprising a second guide assembly adjacent an opposing second side of the abrasive medium, the control circuit transitioning from the first speed to the second speed responsive to the user sequentially placing the cutting tool in each of the first and second guide assemblies.

14. The sharpener of claim 1, further comprising a user indicator device configured to output different visual indications to the user to place and subsequently remove the cutting tool from the guide assembly during continued movement of the abrasive medium.

15. A method for sharpening a cutting tool, comprising:

advancing a moveable abrasive medium having an abrasive surface along a path at a first speed relative to a guide assembly;

presenting the cutting tool against the medium using the guide assembly to apply a coarse sharpening operation to the cutting tool;

reducing a speed of the moveable abrasive medium to a lower, second speed relative to the guide assembly; and subsequently presenting the cutting tool against the medium using the guide assembly to apply a fine sharpening operation to the cutting tool, wherein a transfer assembly and an electric motor are used to transfer mechanical torque generated by the motor to the medium responsive to a first control input value from the control circuit to establish movement of the medium at the first speed and responsive to a different, second control input value from the control circuit to establish movement of the medium at the second speed.

16. The method of claim 15, wherein the medium is an endless abrasive belt.

17. The method of claim 16, wherein the belt is arranged to pass over at least first and second rollers each rotatable about an associated roller axis, the guide assembly having at least one edge guide surface configured to present the cutting edge of the cutting tool along a presentation line that is non-parallel to said roller axes.

18. The method of claim 15, wherein a burr is formed during the presenting step and the burr is removed during the subsequently presenting step.

19. The method of claim 15, wherein the abrasive medium is a rotatable abrasive disc.

20. The method of claim 19, wherein the rotatable abrasive disc is a flexible abrasive disc, and wherein centrifugal forces during rotation of the disc place the disc in a neutral plane.

21. The method of claim 15, wherein the control circuit directs the transfer assembly to move the medium in a first direction with respect to the guide assembly during the coarse sharpening operation and directs the transfer assembly to move the medium in an opposing, second direction with respect to the guide assembly during the fine sharpening operation.

22. The method of claim 15, further comprising using a sensor adjacent the guide assembly to output an electrical signal responsive to detection, by the sensor, of a presence of the cutting tool within the guide assembly in contact with the abrasive medium.

23. The method of claim 15, further comprising using a counter circuit configured to accumulate a count value comprising a total number of successive strokes of the cutting tool through the guide assembly and against the medium by the user while the medium is moved at the first speed, and transitioning the medium from the first speed to the second speed responsive to the accumulated count value from the counter circuit reaching a predetermined threshold value.

24. The method of claim 15, further comprising using a sensor to detect a change in a characteristic of the cutting edge during the coarse sharpening process, and transitioning the medium from the first speed to the second speed responsive to the sensor.

25. The method of claim 15, further comprising initiating a timer circuit to denote a predetermined elapsed time interval, and transitioning the medium from the first, higher speed to the second, lower speed responsive to the timer circuit indicating a conclusion of the predetermined elapsed time interval.

26. The method of claim 15, wherein the guide assembly is characterized as a first guide assembly adjacent a first side of the abrasive medium, both the coarse sharpening operation and the fine sharpening operation are applied to a first side of the cutting tool, a second guide assembly is disposed adjacent a second side of the abrasive medium, and the method further comprises the following steps:

subsequently presenting the cutting tool against the medium using the second guide assembly to apply a coarse sharpening operation to the second side of the cutting tool after the advancing and presenting steps and before the reducing and subsequently presenting steps are applied to the first side of the tool while the medium is moving at the first speed; and subsequently presenting the cutting tool against the medium using the second guide assembly to apply a fine sharpening operation to the second side of the cutting tool after the reducing and subsequently presenting steps are applied to the first side of the tool.

27. The method of claim 26, further comprising using a user indicator device to provide different visual indications to the user to place and subsequently remove the cutting tool from the first and second guide assemblies during continued movement of the abrasive medium.

28. A method for sharpening a cutting tool, comprising:

advancing a moveable abrasive medium having an abrasive surface along a path at a first speed;

presenting a first side of the cutting tool against the medium using a first guide assembly adjacent a first side of the medium to apply a coarse sharpening operation to the first side of the cutting tool while the medium moves at the first speed;

presenting an opposing, second side of the cutting tool against the medium using a second guide assembly adjacent a second side of the medium to apply a coarse sharpening operation to the second side of the cutting tool while the medium moves at the first speed;

reducing a speed of the moveable abrasive medium to a lower, second speed;

subsequently presenting the first side of the cutting tool against the medium using the first guide assembly to apply a fine sharpening operation to the first side of the cutting tool while the medium moves at the second speed; and subsequently presenting the second side of the cutting tool against the medium using the second guide assembly to apply a fine sharpening operation to the second side of the cutting tool while the medium moves at second speed.

29. A method for sharpening a cutting tool, comprising:

advancing a moveable abrasive medium having an abrasive surface along a path at a first speed relative to a guide assembly;

presenting the cutting tool against the medium using the guide assembly to apply a coarse sharpening operation to the cutting tool, the coarse sharpening operation carried out by a user applying a plurality of successive strokes of the cutting tool through the guide assembly and against the medium while the medium is moved at the first speed;

using a counter circuit to accumulate a count value comprising a total number of the successive strokes of the cutting tool through the guide assembly and against the medium by the user while the medium is moved at the first speed;

reducing a speed of the moveable abrasive medium to a lower, second speed relative to the guide assembly responsive to the accumulated count value reaching a predetermined threshold; and subsequently presenting the cutting tool against the medium using the guide assembly to apply a fine sharpening operation to the cutting tool, the fine sharpening operation carried out by a user applying a plurality of successive strokes of the cutting tool through the guide assembly and against the medium while the medium is moved at the second speed.

* * * * *